US011304544B2

(12) United States Patent
Berents et al.

(10) Patent No.: US 11,304,544 B2
(45) **Date of Patent: *Apr. 19, 2022**

(54) SYSTEM COMPRISING A DISPLAY UNIT FOR STORING AND DISPLAYING FOOD PRODUCTS, AND MULTIPLE SHELVES, AND METHOD FOR STORING AND DISPLAYING FOOD PRODUCTS IN A DISPLAY UNIT

(71) Applicant: Fri-Jado B.V., Oud Gastel (NL)

(72) Inventors: Robert Evert Willem Berents, Berkel-Enschot (NL); Johannes Gerrad Kappers, Maassluis (NL); Thomas Adrianus Maria Van Bergen, Goirle (NL)

(73) Assignee: Fri-Jado B.V., Oud Gastel (NL)

( * ) Notice: Subject to any disclaimer, the term of this patent is extended or adjusted under 35 U.S.C. 154(b) by 0 days.

This patent is subject to a terminal disclaimer.

(21) Appl. No.: 17/064,665

(22) Filed: Oct. 7, 2020

(65) Prior Publication Data

US 2021/0106150 A1 Apr. 15, 2021

(30) Foreign Application Priority Data

Oct. 9, 2019 (NL) ..... 2023983
Oct. 9, 2019 (NL) ..... 2023984
Oct. 9, 2019 (NL) ..... 2023985

(51) Int. Cl.
*A47F 3/04* (2006.01)
*A47F 3/00* (2006.01)
(Continued)

(52) U.S. Cl.
CPC ..... *A47F 3/0447* (2013.01); *A47F 3/001* (2013.01); *A47F 3/005* (2013.01); *A47F 3/0486* (2013.01);
(Continued)

(58) Field of Classification Search
CPC ..... F25D 2317/0665; F25D 2317/0672; A47F 2003/046; A47F 7/0071; A47F 3/001;
(Continued)

(56) References Cited

U.S. PATENT DOCUMENTS 2,763,135 A * 9/1956 Fredericks ..... A47F 3/0408 62/255
2,836,039 A * 5/1958 Weber ..... A47F 3/0447 62/252
(Continued)

FOREIGN PATENT DOCUMENTS

DE 3116565 A1 6/1982
EP 0709046 A2 5/1996
(Continued)

OTHER PUBLICATIONS

Search Report and Written Opinion for NL2023983 dated Jan. 11, 2020.
(Continued)

*Primary Examiner* — Patrick D Hawn
(74) *Attorney, Agent, or Firm* — Rogowski Law LLC

(57) ABSTRACT

A system comprises a display unit and shelves. The display unit has an open front chamber for storing food products, a lower air duct with a lower front inlet, an upper air duct with an upper front outlet, a fan and an air refrigerator. The upper front outlet is directed at the lower front inlet for creating an air curtain in front of the open front. At least one of the shelves is a hollow shelf with an inner space, a shelf air outlet at a front side, a shelf air inlet at a back side, a fan, and a shelf heater. The fan is in fluid connection with the shelf air inlet and the shelf air outlet for moving air from the shelf air inlet through the hollow shelf to the shelf air outlet.

19 Claims, 4 Drawing Sheets

(51) Int. Cl.
*A47F 7/00* (2006.01)
*A47F 3/06* (2006.01)

(52) U.S. Cl.
CPC ..... *A47F 7/0071* (2013.01); *A47F 3/06* (2013.01); *A47F 2003/046* (2013.01)

(58) Field of Classification Search
CPC .. A47F 3/005; A47F 3/007; A47F 3/04; A47F 3/0439; A47F 3/0443; A47F 3/0447; A47F 3/0452; A47F 3/0456; A47F 3/0465
See application file for complete search history.

(56) References Cited

U.S. PATENT DOCUMENTS 3,186,185 A * 6/1965 Bently ..... A47F 3/0469 62/255
3,369,375 A * 2/1968 Gerweck ..... A47F 3/0447 62/256
3,392,544 A * 7/1968 Perez ..... A47F 3/0447 62/256
3,812,684 A * 5/1974 Brown ..... A47F 3/0447 62/89
3,827,254 A * 8/1974 MacMaster ..... A47F 3/0447 62/256
3,850,003 A * 11/1974 Beckwith ..... A47F 3/0447 62/82
3,937,033 A * 2/1976 Beckwith ..... A47F 3/0447 62/155
4,144,720 A * 3/1979 Subera ..... F25D 21/125 62/256
4,269,037 A * 5/1981 Karashima ..... A47F 3/0447 62/256
4,326,385 A * 4/1982 Ibrahim ..... F25D 21/125 62/256
4,375,155 A * 3/1983 Rosanio ..... A47F 3/0408 62/256
4,389,852 A * 6/1983 Abraham ..... F25D 21/125 62/256
4,777,806 A * 10/1988 Perez ..... A47F 3/0447 62/256
4,938,034 A * 7/1990 Rosanio ..... A47F 3/0447 62/256
5,357,767 A * 10/1994 Roberts ..... A47F 3/0447 454/193
6,742,344 B2 * 6/2004 Vormedal ..... A47F 3/0447 62/89
6,886,359 B2 * 5/2005 Yamazaki ..... A47F 3/0443 454/193
7,036,947 B2 * 5/2006 Chuang ..... A47F 3/0443 362/92
7,121,104 B2 * 10/2006 Howington ..... A47B 57/045 62/256
7,137,438 B2 * 11/2006 Nomura ..... F25D 25/02 165/64
7,162,882 B2 * 1/2007 Alahyari ..... A47F 3/0447 62/89
7,681,409 B2 * 3/2010 Alahyari ..... A47F 3/0447 62/255
9,265,359 B2 * 2/2016 Wood ..... A47F 3/0478
9,565,954 B2 * 2/2017 Nuttall ..... A47F 3/0443
9,675,185 B2 * 6/2017 Anderson ..... A47F 3/0447
9,788,666 B2 * 10/2017 Wood ..... A47F 3/0447
10,219,638 B2 * 3/2019 Wood ..... A47F 3/0447
11,045,018 B2 * 6/2021 Berents ..... A47F 3/005
2004/0177634 A1 * 9/2004 Yamazaki ..... A47F 3/0443 62/248
2006/0199495 A1 * 9/2006 Yamaguchi ..... A47F 3/0491 454/173
2006/0240761 A1 * 10/2006 Yamaguchi ..... A47F 3/001 454/184
2006/0290242 A1 * 12/2006 Coval ..... A47F 3/0443 312/114
2010/0024446 A1 * 2/2010 Rohrer ..... A47F 3/0447 62/89
2010/0313588 A1 * 12/2010 Swofford ..... A47F 3/0443 62/251
2011/0147362 A1 * 6/2011 Van Dorst ..... A47F 3/001 219/218
2019/0281997 A1 * 9/2019 Nicholls ..... A47F 3/0491
2019/0328154 A1 * 10/2019 Berents ..... A47F 3/0443
2020/0121129 A1 4/2020 Wittig

FOREIGN PATENT DOCUMENTS

JP 2007209513 A 8/2007
WO 2018007971 A1 1/2018
WO 2018193172 A1 10/2018

OTHER PUBLICATIONS

Search Report and Written Opinion for NL2023984 dated Jan. 11, 2020.
Search Report and Written Opinion for NL2023985 dated Jan. 11, 2020.

* cited by examiner

SYSTEM COMPRISING A DISPLAY UNIT FOR STORING AND DISPLAYING FOOD PRODUCTS, AND MULTIPLE SHELVES, AND METHOD FOR STORING AND DISPLAYING FOOD PRODUCTS IN A DISPLAY UNIT

BACKGROUND OF THE INVENTION

Technical Field and State of the Art

A display unit for food products is used in commercial areas, such as convenience stores, quick service restaurants, petrol stations, and other food-to-go locations. The food products are held in a chamber of the display unit to be kept cold, or kept hot, depending on the type of product. Buyers can see what food products are available, and grab one via the open front.

A display unit of this type is known from U.S. Pat. No. 2,993,349, which discloses a refrigerated display case with an open front chamber, side walls, a bottom and a top wall, a back door, a top blower, a bottom blower, an upper refrigerating unit, and a lower refrigerating unit, as well as upper and lower air inlets and outlets. The upper front outlet is directed at the lower front inlet for creating a front air curtain in front of the open front.

A disadvantage of the known display unit is that it is not flexible in use. In the past, commercial areas would be used mainly at a particular time of a day. A commercial area which would be open during daytime would typically employ a refrigerated display unit, e.g. for storing drinks and sandwiches. A commercial area which would be open in the late afternoon and evenings, would rather have a heated display unit for hot snacks. Currently, commercial areas tend to be open longer hours, serving refrigerated food products part of the day, and hot food products during the remainder of the day. This requires switching a refrigerated display unit for a heated display unit every day, leading to double investments, downtime while switching the display units, and extra storage area for the display unit which is not in use.

The invention aims to solve at least one of these problems, or at least to provide an alternative. In particular, the invention aims to provide a display unit which is more flexible in use than in the prior art display unit.

SUMMARY OF THE INVENTION

A system comprises a display unit for storing and displaying food products, and multiple shelves. The display unit has a front side and a back side, and comprises a top wall, a left side wall, a right side wall, a bottom wall, a back wall, an air circulation system, and a first air refrigerator. The top, left side, right side, bottom, and back walls delimit an open front chamber for the food products, such that the chamber is accessible from the open front. The multiple shelves each comprise a placing side. The multiple shelves are placeable in the display unit to each extend in the chamber in a vertical spaced relationship and to define an individual corresponding storage space above the respective placing side. The air circulation system comprises a lower air duct with a lower front inlet, an upper air duct with an upper front outlet, and a first air forcing apparatus. The first air forcing apparatus is provided for moving air through the at least one air duct, from the lower front inlet towards the upper front outlet. The first air refrigerator is provided for cooling the air which is moved from the lower front inlet towards the upper front outlet. The upper front outlet is directed at the lower front inlet for creating a front air curtain in front of the open front. At least one of the multiple shelves is, and in particular all the multiple shelves are, a hollow shelf with an inner space, a front side and a back side, which in use correspond to the front side and the back side of the display unit. The hollow shelf comprises at least one shelf air outlet at the front side, at least one shelf air inlet at the back side, a shelf air forcing apparatus, and a shelf heater. The shelf air forcing apparatus is in fluid connection with the shelf air inlet and the shelf air outlet for moving air from the shelf air inlet through the hollow shelf to the shelf air outlet.

The inventive hollow shelf with the inner space, the shelf air inlet at the back side, the shelf air outlet at the front side, the shelf air forcing apparatus, and the shelf heater together provide the possibility to heat the storage space above the respective placing side. At the same time, the air circulation system and the air refrigerator provide the possibility to refrigerate the open front chamber with the storage spaces. Accordingly, one only needs to put on the air circulation system and refrigerator to turn the display unit into a refrigerated display unit, and to put the air circulation system and air refrigerator off, and the shelf air forcing apparatus and the shelf heater on to turn the display unit into a heated display unit. This obviates the need for a separate refrigerated display unit and heated display unit, while still being able to intermittently serve cold and heated food products.

In an embodiment, the shelf heater is provided in the inner space for heating the air in the inner space of the hollow shelf. This provides a compact solution.

In an embodiment, the shelf heater is positioned to provide heat to the placing side. This results in heating the food products via heated air and via the placing side.

In particular, the shelf heater is provided in the inner space for heating the air and the shelf heater is positioned to provide heat to the placing side. Heating the food products via heated air and via the placing side results in a balanced heat transfer which less effects the quality of the food products.

In an embodiment, the shelf heater is a flat heating element extending in the inner space.

In an embodiment, the inner space of the hollow shelf fluidly connects the at least one shelf air inlet with the at least one shelf air outlet. This obviates the need for separate air ducts inside the hollow shelf.

In an embodiment, the at least one shelf air outlet defines a flow direction for air flowing out of the outlet, and the flow direction points away upwards from the placing side and backwards towards the back side of the hollow shelf, such that in use the air flowing out of the outlet is directed substantially entirely into the corresponding storage space. This results in a combination of an upward directed air screen in front of the food products in the storage space and a backward moving air screen which is not directly directed at, but still moves along, the food products for heating them. As the moving hot air is not directly directed at the food products, these food products deteriorate less quickly.

In an embodiment, the shelf air forcing apparatus is provided inside the inner space. This provides a compact solution.

In an embodiment, the display unit comprises shelf support means and at least one of the shelves comprises corresponding connection means for removably attaching the relevant shelf in the open front chamber, in particular the display unit comprises multiple shelf support means at different heights for supporting the at least one of the shelves at different vertical positions in the display unit. This increases the flexibility of the display unit.

In an embodiment, the air circulation system further comprises a lower back outlet at the lower air duct, and an upper back inlet at the upper air duct, and the lower back outlet is directed at the upper back inlet for creating a back air curtain in front of the back wall. The combination of a back air curtain and a front air curtain envelops the open front chamber in refrigerated air, thus keeping food products in the open front chamber at a desired low temperature.

In particular, the back side of the hollow shelf is spaced horizontally from the back wall, when positioned in the display unit, for providing sufficient space for the back air curtain between the back side of the hollow shelf and the back wall. This improves the suitability of the hollow shelf for supporting refrigerated food products while the display unit generates a back air curtain, and obviates the need to replace the hollow shelf for another shelf when the display unit is used to refrigerated food products.

More in particular, the hollow shelf comprises a replaceable back portion for extending the hollow shelf to the back wall of the display unit. This improves the air circulation above the hollow shelf when the hollow shelf is used to heat food products.

Even more in particular, the replaceable back portion comprises a joint, more in particular a pivot, in order to move the removable portion from a retracted position, wherein the back side of the hollow shelf is spaced horizontally from the back wall, to an extended position, wherein the back side of the replaceable back portion is positioned at the back wall. This makes it easier for a user to convert the hollow shelf from a configuration for refrigerating food products to heating food products.

In an embodiment, the back wall comprises a back door. The back door enables providing food products to the open front chamber from the back, i.e. from a side where no consumers are. In particular the back door is a sliding door, which reduces the amount of space which is required behind the display unit.

In an embodiment, at least one further one of the multiple shelves is a flat shelf without a shelf air forcing apparatus. This makes it possible to optimise the hollow shelf for heating food products, because it is replaced completely when the display unit is used to refrigerate food products.

In an embodiment, at least one of the upper front outlet and the lower back outlet is provided with slats for guiding the air curtain, in particular for directing the air curtain and/or creating a laminar flow air curtain. The slats ensure a more concentrated air curtain, than the air curtains of the prior art which deliberately flow into the display space, as shown and described in the description and FIG. 1 of U.S. Pat. No. 2,993,349 as "rotating currents of air 50". These rotating currents affect the quality of some types of food products. In contrast, the slats direct the air curtain and/or create a substantial laminar air flow which decreases the speed of air inside the chamber considerably with respect to the prior art, so that food products maintain the required quality longer. At the same time, the air curtains in the front and the back of the display unit ensure that the chamber and the food products in the chamber are kept at a desired low temperature level, even when the back door is opened to add new food products.

In an embodiment, at least one of the multiple walls is a transparent wall, the display unit further comprises a conduit wall, which is positioned substantially in parallel to, and at the chamber side of, the transparent wall for creating an air conduit between the conduit wall and the transparent wall. The air conduit comprises a first conduit inlet, a second conduit inlet, and a conduit outlet. The first conduit inlet is in fluid connection with the at least one air duct for diverting a portion of the air moving through the at least one air duct into the air conduit, and the second conduit inlet is in fluid connection with ambient air outside of the display unit. This reduces the risk of condensation on the transparent wall.

A method for storing and displaying food products in a display unit comprises providing a display unit, wherein the display unit comprises an air refrigerator, providing at least one hollow shelf with a shelf air inlet at a back side, and a shelf air outlet at a front side, providing food products on the hollow shelf, sucking in air through the shelf air inlet, moving the sucked in air from the shelf air inlet through the hollow shelf to the shelf air outlet, heating the moving air in the hollow shelf, and blowing the heated air out of the shelf air outlet.

In an embodiment of the method, the heated air which is blown out of the shelf air outlet is blown upwards and backward, substantially entirely into a storage space above the shelf.

According to a second aspect of the invention, a system comprises a display unit for storing and displaying food products, and multiple shelves. The display unit has a front side and a back side, and comprises a top wall, a left side wall, a right side wall, and a bottom wall, a back door, a lower air duct, an upper air duct, a first air forcing apparatus, a first air refrigerator, and an upper air treatment system. The upper air treatment system comprises at least one of a second air forcing apparatus, the first air refrigerator, and a second air refrigerator. The top, left side, right side, and bottom walls and the back door delimit an open front chamber for the food products. The chamber is accessible from the open front and by opening the back door. The multiple shelves are placeable in the display unit to each extend in the chamber in a vertical spaced relationship. The lower air duct extends from at least one lower front inlet to at least one lower back outlet. The upper air duct extends from at least one upper back inlet to at least one upper front outlet. The first air forcing apparatus is provided at the lower air duct. The upper air treatment system is provided at the upper air duct. The lower back outlet is directed at the upper back inlet for creating a back air curtain in front of the back door, and the upper front outlet is directed at the lower front inlet for creating a front air curtain in front of the open front. At least one of the upper front outlet and the lower back outlet is provided with slats for guiding the air curtain, in particular for directing the air curtain and/or creating a laminar flow air curtain.

The slats ensure a more concentrated air curtain, than the air curtains of the prior art which deliberately flow into the display space, as shown and described in the description and FIG. 1 of U.S. Pat. No. 2,993,349 as 'rotating currents of air 50'. These rotating currents affect the quality of some types of food products. In contrast, the slats direct the air curtain and/or create a substantial laminar air flow which decreases the speed of air inside the chamber considerably with respect to the prior art, so that food products maintain the required quality longer. At the same time, the air curtains in the front and the back of the display unit ensure that the chamber and the food products in the chamber are kept at a desired low temperature level, even when the back door is opened to add new food products.

In an embodiment, the slats are arranged in parallel. This provides for a simple solution.

In an embodiment, the slats define an open honeycomb structure. This further improves the direction and compactness of the air curtain.

In an embodiment, both the upper outlet and the lower are provided with slats.

In an embodiment, the first air refrigerator is provided in the lower air duct, and the second air forcing apparatus is provided in the upper air duct. The second air forcing apparatus increases the pressure and thus flow velocity at the upper front outlet, thus improving the front air curtain.

In an embodiment, the back door comprises at least one sliding door. A sliding door reduces the space which needs to be available at the back of the display unit, and thus increases the number of places where the inventive display unit may be used.

In an embodiment, a back edge of each of the multiple shelves is spaced horizontally from the back door. This creates space for the back air curtain.

In an embodiment, the display unit comprises shelf support means and at least one of the shelves comprises corresponding connection means for removably attaching the relevant shelf in the chamber. This increases the flexibility of the display unit.

In particular, the display unit comprises multiple shelf support means at different heights for supporting the at least one of the shelves at different vertical positions in the display unit.

In an embodiment, at least one of the multiple walls is a transparent wall, the display unit further comprises a conduit wall, which is positioned substantially in parallel to, and at the chamber side of, the transparent wall for creating an air conduit between the conduit wall and the transparent wall. The air conduit comprises a first conduit inlet, a second conduit inlet, and a conduit outlet. The first conduit inlet is in fluid connection with the at least one air duct for diverting a portion of the air moving through the at least one air duct into the air conduit, and the second conduit inlet is in fluid connection with ambient air outside of the display unit. This reduces the risk of condensation on the transparent wall.

In an embodiment, at least one of the multiple shelves is a hollow shelf with an inner space, a front side and a back side, which in use correspond to the front side and the back side of the display unit. The hollow shelf comprises at least one shelf air outlet at the front side, at least one shelf air inlet at the back side, a shelf air forcing apparatus, and a shelf heater. The shelf air forcing apparatus is in fluid connection with the shelf air inlet and the shelf air outlet for moving air from the shelf air inlet through the hollow shelf to the shelf air outlet.

The invention further relates to the use of the above defined system.

According to a third aspect of the invention, a system comprising a display unit for storing and displaying food products, and multiple shelves, wherein the display unit has a front side and a back side, and comprises multiple walls, including a top wall, a left side wall, a right side wall, a bottom wall, and a back wall, and further comprises an air circulation system, and a first air refrigerator. The top, left side, right side, bottom, and back walls delimit an open front chamber for the food products, such that the chamber is accessible from the open front. The multiple shelves are placeable in the display unit to each extend in the chamber in a vertical spaced relationship. The air circulation system comprises a lower air duct with a lower front inlet, an upper air duct with an upper front outlet, and a first air forcing apparatus. The first air forcing apparatus is provided for moving air through the lower and upper air ducts, from the lower front inlet towards the upper front outlet. The first air refrigerator is provided for cooling the air which is moved from the lower front inlet towards the upper front outlet. The upper front outlet is directed at the lower front inlet for creating a front air curtain in front of the open front. At least one of the multiple walls is a transparent wall. The display unit further comprises a conduit wall, which is positioned substantially in parallel to, and at the chamber side of, the transparent wall for creating an air conduit between the conduit wall and the transparent wall. The air conduit comprises a first conduit inlet, a second conduit inlet, and a conduit outlet. The first conduit inlet is in fluid connection with the lower or upper air duct for diverting a portion of the air moving through the air duct into the air conduit, and the second conduit inlet is in fluid connection with ambient air outside of the display unit.

The transparent wall increases the visibility of the food items for consumers. In particular the content of smaller display units and/or display units which are positioned in a congested area and/or at low altitude with respect to the user becomes better visible as a consumer may look through a transparent wall, e.g. a transparent top wall, to see what food items are on sale. However, condensation of water would usually occur on the transparent wall due to the temperature difference between the inside and the outside of the display unit. In order to mitigate this, the conduit wall is positioned substantially in parallel to, and at the chamber side of, the transparent wall for creating the air conduit between the conduit wall and the transparent wall. By letting in air at ambient temperature via the second conduit inlet, there is less temperature difference between both sides of the transparent wall which results in less, or even no, condensation on the transparent wall. At the same time, condensation is prevented on the conduit wall by letting in cooled air from the air duct via the first conduit inlet.

In an embodiment, the first conduit inlet is arranged for diverting a maximum of 10%, in particular a maximum of 5%, more in particular substantially 2% of the air moving through the at least one air duct into the air conduit.

In an embodiment, the first conduit inlet is positioned adjacent of the conduit wall and/or the second conduit inlet is positioned adjacent of the transparent wall. This improves the distribution of the air temperature inside the air conduit.

In an embodiment, the conduit wall is a transparent conduit wall. This further improves the visibility of the food products inside the open front chamber.

In an embodiment, the top wall is the transparent wall. This enables a consumer to see the food products inside the open front chamber from a relative high position with respect to the display unit.

In an embodiment, the upper air duct comprises the conduit wall, and at least one upper duct lower wall. The conduit wall thus serves as upper duct upper wall too. As a result, the upper air duct is positioned close to the top wall of the display unit, while the chance of condensation occurring on the top, the upper duct upper wall, and/or the upper duct lower wall is considerably reduced.

In particular, the upper duct upper wall is a transparent upper duct upper wall.

In an embodiment, the air circulation system further comprises a lower back outlet at the lower air duct, and an upper back inlet at the upper air duct, and the lower back outlet is directed at the upper back inlet for creating a back air curtain in front of the back wall, wherein in particular the back wall comprises a back door. This creates an air circulation around the open front chamber which keeps the food products at a desired temperature. The back door enables providing food products to the open front chamber from the back, i.e. from a side where no consumers are.

In an embodiment, at least one of the upper front outlet and the lower back outlet is provided with slats for guiding the air curtain, in particular for directing the air curtain and/or creating a laminar flow air curtain. The slats ensure a more concentrated air curtain, than the air curtains of the prior art which deliberately flow into the display space, as shown and described in the description and FIG. 1 of U.S. Pat. No. 2,993,349 as "rotating currents of air 50". These rotating currents affect the quality of some types of food products. In contrast, the slats direct the air curtain and/or create a substantial laminar air flow which decreases the speed of air inside the chamber considerably with respect to the prior art, so that food products maintain the required quality longer. At the same time, the air curtains in the front and the back of the display unit ensure that the chamber and the food products in the chamber are kept at a desired low temperature level, even when the back door is opened to add new food products.

In an embodiment, at least one of the multiple shelves is a hollow shelf with an inner space, a front side and a back side, which in use correspond to the front side and the back side of the display unit. The hollow shelf comprises at least one shelf air outlet at the front side, at least one shelf air inlet at the back side, a shelf air forcing apparatus, and a shelf heater. The shelf air forcing apparatus is in fluid connection with the shelf air inlet and the shelf air outlet for moving air from the shelf air inlet through the hollow shelf to the shelf air outlet. The inventive hollow shelf with the inner space, the shelf air inlet at the back side, the shelf air outlet at the front side, the shelf air forcing apparatus, and the shelf heater together provide the possibility to heat the storage space above the respective upper placing side. At the same time, the air circulation system and the air refrigerator provide the possibility to refrigerate the open front chamber with the storage spaces. Accordingly, one only needs to put on the air circulation system and refrigerator to turn the display unit into a refrigerated display unit, and to put the air circulation system and air refrigerator off, and the shelf air forcing apparatus and the shelf heater on to turn the display unit into a heated display unit. This obviates the need for a separate refrigerated display unit and heated display unit, while still being able to intermittently serve cold and heated food products.

In an embodiment, the display unit comprises shelf support means and at least one of the shelves comprises corresponding connection means for removably attaching the relevant shelf in the chamber. This increases the flexibility of the display unit.

A method for storing and displaying refrigerated food products in a display unit comprises:

providing a display unit and shelves, wherein the display unit comprises a chamber for the refrigerated food products, a transparent wall, and a conduit wall, which is positioned substantially in parallel to, and at the chamber side of, the transparent wall for creating an air conduit between the conduit wall and the transparent wall, providing food products on one or more of the shelves, providing refrigerated air for cooling the food products, wherein a part of the refrigerated air is guided through the air conduit, and guiding ambient air through the air conduit.

In an embodiment of the method, the ambient air is guided along the transparent wall.

In an embodiment of the method, the refrigerated air which is guided through the air conduit is guided along the conduit wall.

In an embodiment of the method, the temperature of the transparent wall is above the dew point of the ambient air at the transparent wall.

In an embodiment of the method, the temperature of the conduit wall is above the dew point of the air in the air conduit at the conduit wall.

All embodiments as described with respect to the second and third aspect of the invention may be combined with those of the first aspect of the invention.

DESCRIPTION OF THE DRAWINGS

The invention, its effects, and advantages will be explained in more detail on the basis of the schematic drawing, in which.

DETAILED DESCRIPTION

Figure 1:
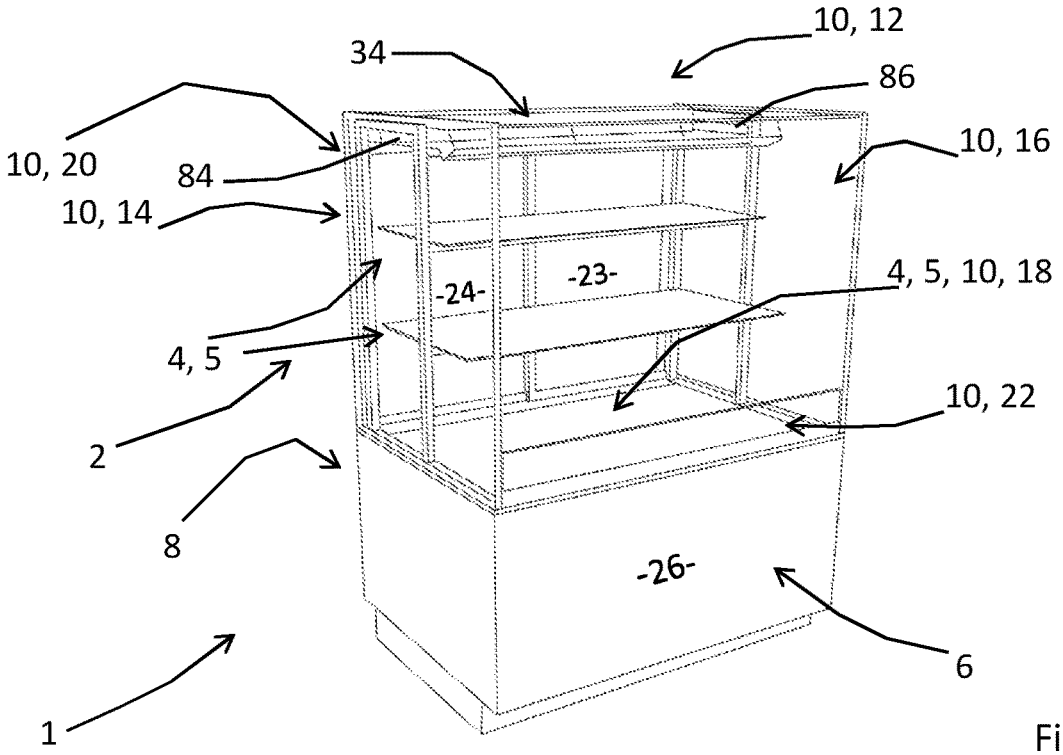
FIG. 1 shows a perspective view of a first embodiment of a system according to the invention.

FIG. 1 shows a system, which is denoted in its entirety by reference number 1, with a display unit 2 and multiple shelves 4, according to the invention. In this embodiment, the multiple shelves 4 are flat shelves 5, i.e. shelves without an inner space. While the different embodiments which are shown in the figures differ in detail, the same or similar elements will be denoted with the same name and reference number and will not be described in detail in relation to each embodiment, in order to prevent unnecessary repetition.

The display unit 2 is designed for storing and displaying refrigerated or hot food products. The display unit 2 has a front side 6 and a back side 8, and comprises multiple walls 10, including a top wall 12, a left side wall 14, a right side wall 16, a bottom wall 18, a back wall 20, and a lower (partial) front wall 22. The back wall 20 comprises back doors, in this embodiment a first slidable back door 23 and a second slidable back door 24. The first slidable back door 23 and the second slidable back door 24 are slidable in a horizontal direction. The display unit 2 of the first embodiment is supported on a support frame 26, in this case a closed frame. It is noted that no support frames are shown for the other embodiments, and that the presence or absence of such support frame is not relevant for the claimed invention.

Figure 2:
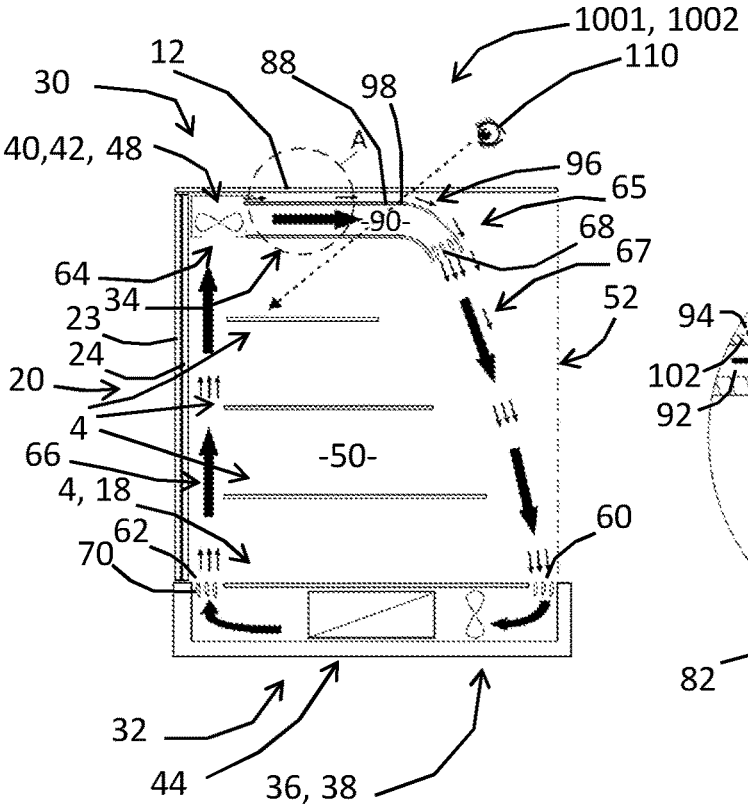
FIG. 2 shows a cross-section view of a second embodiment of the invention.

Referring to FIG. 2, a system 1001 with a display unit 1002 is shown with the same or similar elements as in the previous embodiment. The display unit 1002 comprises an air circulation system 30 with a lower air duct 32, an upper air duct 34, a first air forcing apparatus 36, in this embodiment a first axial-flow fan 38, a second air forcing apparatus 40, in this embodiment a second axial-flow fan 42, and a first air refrigerator 44. The display unit 2 further comprises an upper air treatment system 48, which in this embodiment comprises the second axial-flow fan 42. The first axial-flow fan 38 and the first air refrigerator 44 are provided at the lower air duct 32, and the second axial-flow fan 42 is provided at the upper air duct 34.

The top wall 12, left side wall 14, right side wall 16, bottom wall 18, and lower front wall 22 and the back doors 23, 24 delimit an open front chamber 50 for the food products (not shown). The open front chamber 50 is accessible from the open front 52 and by opening one of the back doors 23, 24.

The lower air duct 32 comprises a lower front inlet 60 and lower back outlet 62, and extends from the lower front inlet 60 to the lower back outlet 62. The upper air duct 34 comprises an upper back inlet 64 and an upper front outlet 65, and extends from the upper back inlet 64 to the upper front outlet 65. It is noted that some inlets and outlets are merely openings in the relevant duct wall, while the upper front outlet 65 is formed by a curved duct part in the second and third embodiment, and by a straight duct part which is connected under an obtuse angle with the upper air duct 34 in the first embodiment.

The lower back outlet 62 is directed at the upper back inlet 64 for creating a back air curtain 66 in front of the back doors 23, 24, and the upper front outlet 65 is directed at the lower front inlet 60 for creating a front air curtain 67 in front of the open front 52.

Figure 4:
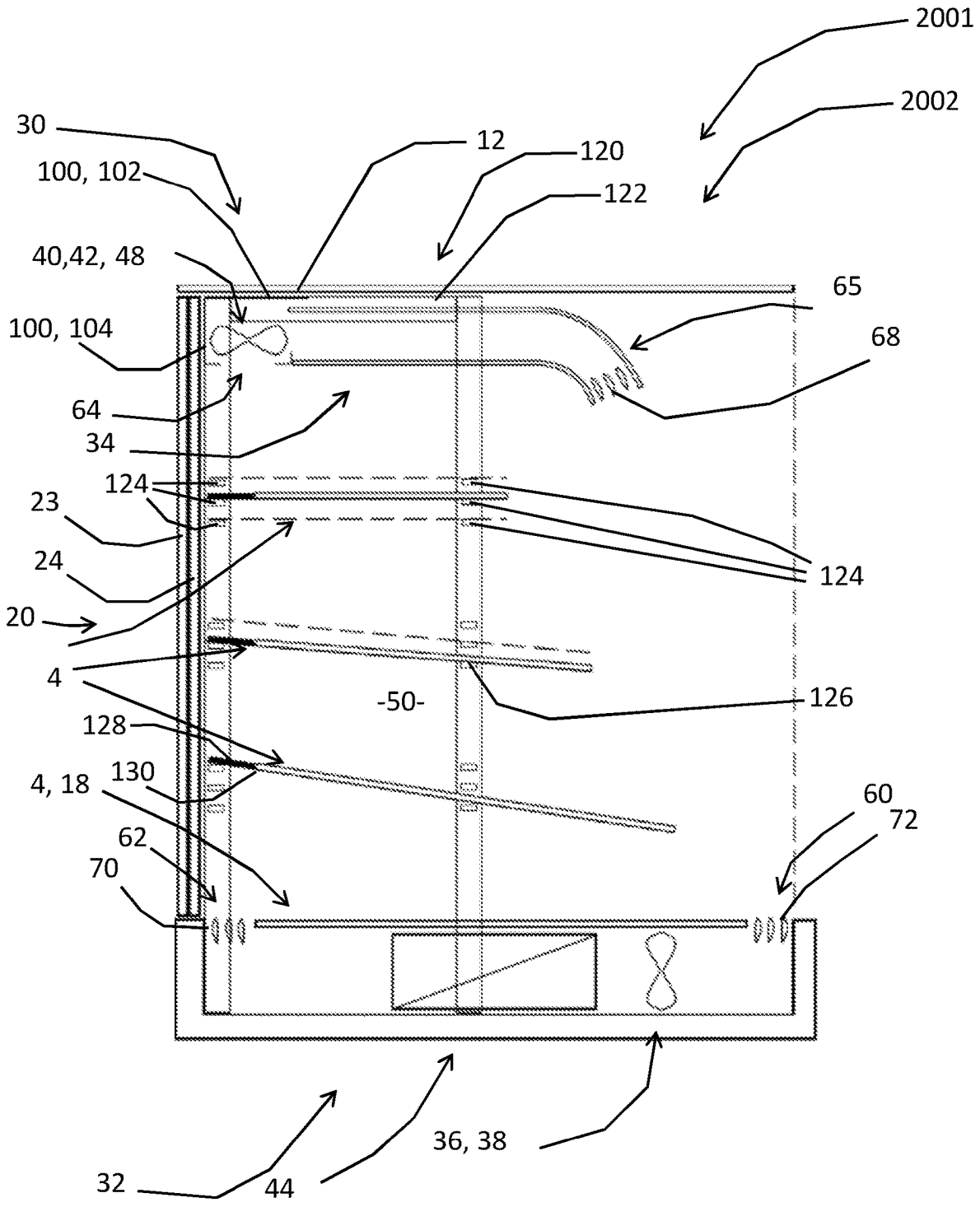
FIG. 4 shows a cross-section view of a third embodiment of the invention.

Referring to FIG. 4, a system 2001 with a display unit 2002 is shown with the same or similar elements as in the previous embodiments. In this embodiment, both the upper front outlet 65 is provided with upper front slats 68 for creating a laminar flow air curtain and directing the air curtain, and the lower back outlet 62 is provided with lower back slats 70 for creating a laminar flow air curtain and directing the air curtain. The lower front inlet 60 is provided with lower front slats 72. The lower front slats 72 prevent objects falling into the front inlet 60. The slats 68, 70, 72 are arranged in parallel. The slats have a length which is larger than its width, while the width is larger than the thickness. In particular, the slat width/slat thickness ratio is at least 4:1. Furthermore, the width of the slats is larger than the distance between the slats (also called slot width). In particular, the slat width/slot width ratio is at least 2:1. The slats preferably have a aerofoil profile as seen in cross-section.

Figure 3:
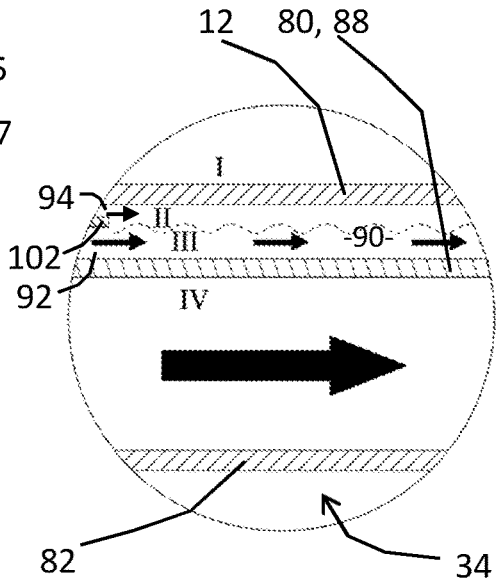
FIG. 3 shows detail A from FIG. 2.

The upper air duct 34 is formed by an upper duct upper wall 80, an upper duct lower wall 82, an upper duct left side wall 84, and an upper right side duct wall 86 (see FIG. 1 for side walls 84, 86). Referring to FIGS. 2 and 3, the upper duct upper wall 80 acts as conduit wall 88, which is positioned substantially in parallel to, and at the chamber side of, the top wall 12 for creating an air conduit 90 between the conduit wall 88 and the top wall 12. The air conduit 90 comprises a first conduit inlet 92, which is positioned adjacent of the conduit wall 88, a second conduit inlet 94, which is positioned adjacent of the top wall 12, and a conduit outlet 96, which is positioned at a front edge 98 of the conduit wall 88. The upper air duct 34 further comprises an upper fan housing 100 for the upper axial-flow fan 42, which upper fan housing 100 comprises an upper fan housing top wall 102, and an upper fan housing back wall 104. Moreover, the upper fan housing 100 comprises the upper back inlet 64.

The upper fan housing top wall 102 is vertically spaced above the conduit wall 88 for forming the first conduit inlet 92, which in this embodiment is slit-shaped (see FIG. 3). The first conduit inlet 92 is in fluid connection with the upper air duct 34 for diverting approximately 2% of the air which is moved through the upper air duct 34 by the upper axial-flow fan 42 into the air conduit 90. The upper fan housing top wall 102 is further vertically spaced below the top wall 12 for forming a slit 106. This slit 106 provides a fluid connection between the second conduit inlet 94 and the ambient air outside of the display unit 2.

The top wall 12, the conduit wall 88, and the upper duct lower wall 82 are transparent walls. This enables a user, schematically indicated with eye 110, to better view the content of the open front chamber 50. In particular, the view from a relative high positioned user is improved. Such a position occurs when the display unit 2 is placed relatively low and/or in a congested space so that the user cannot take a step back to view the content. The left and right side walls 14, 16 are transparent walls too. This improves the visibility from the side.

Referring to FIGS. 1 and 4, the multiple shelves 4 are placeable in the display unit 2 to each extend in the chamber in a vertical spaced relationship. The display unit 2 comprises a shelf support system 120 which comprises two shelf support frames 122 in the shape of an inverted U. The legs of the inverted U are support on, or at, the bottom wall 18. The top of the inverted U is positioned at the top wall 12. Each of the shelf support frames 122 is positioned at the inside of a respective left or right side wall 14, 16. The shelf support system 120 further comprises multiple shelf support means 124 at different heights for supporting the shelves 4 at different vertical positions in the display unit 2, as indicated by dotted lines. The shelf support means 124 are distributed in a vertical spaced relationship over the legs of both shelf support frames 122. The shelves 4 comprise corresponding front connection means 126 and back connection means 128 for removably attaching the relevant shelf 4 in the open front chamber 50.

A back edge 130 of the shelves 4 is spaced from the back door 23, 24, so that the back air curtain 66 can flow between the shelves 4 and the back door 23, 24, as shown in FIG. 2. Note that FIG. 4 shows in black that the back connection means 128 extend beyond the back edge 130 of the relevant shelf 4, so that it is connectable to a backward one of the shelf support means 124. Seen from a top view, the back connection means 128 and the back edge 130 thus form an open U-shape for the back air curtain 66. The shelf support means 124 are provided such, that the shelves 4 are positioned either in a horizontal orientation, or at a slight angle of less than 20 degrees with the horizontal.

Figure 5:
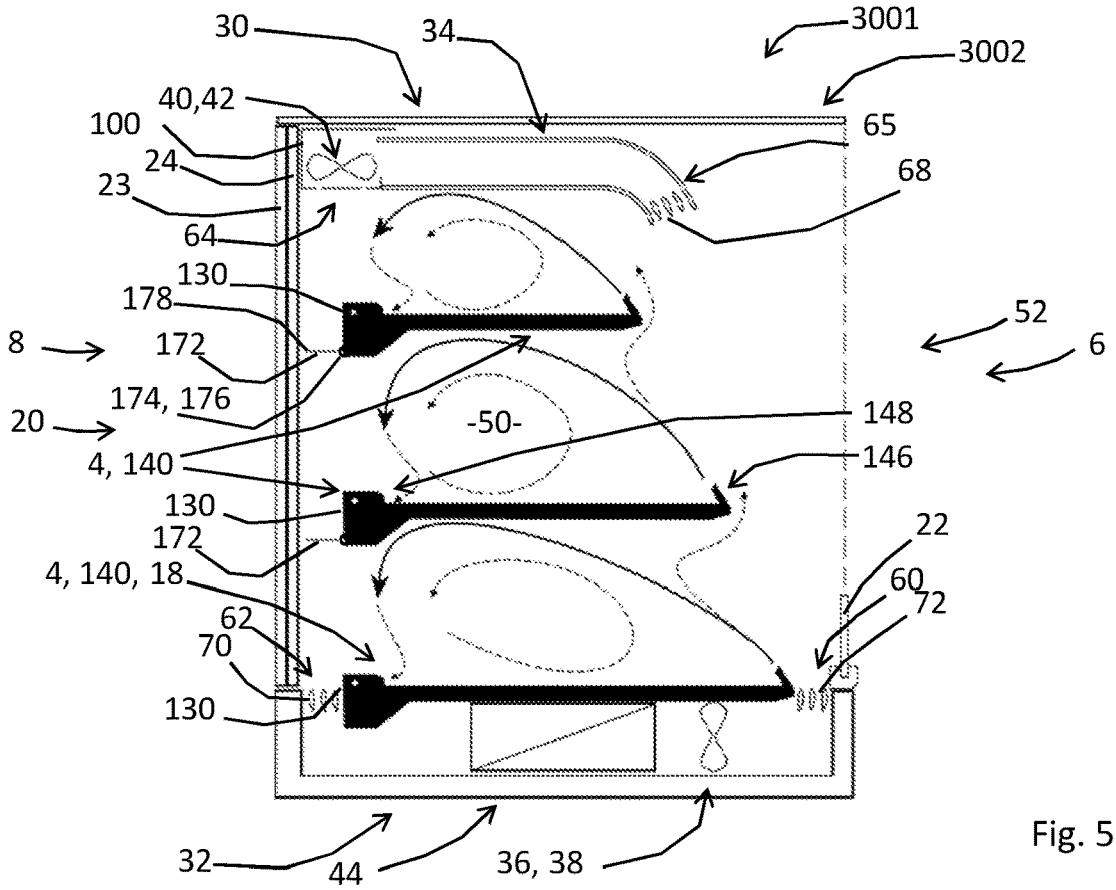
FIG. 5 shows a fourth embodiment, with heated shelves.
Figure 6:
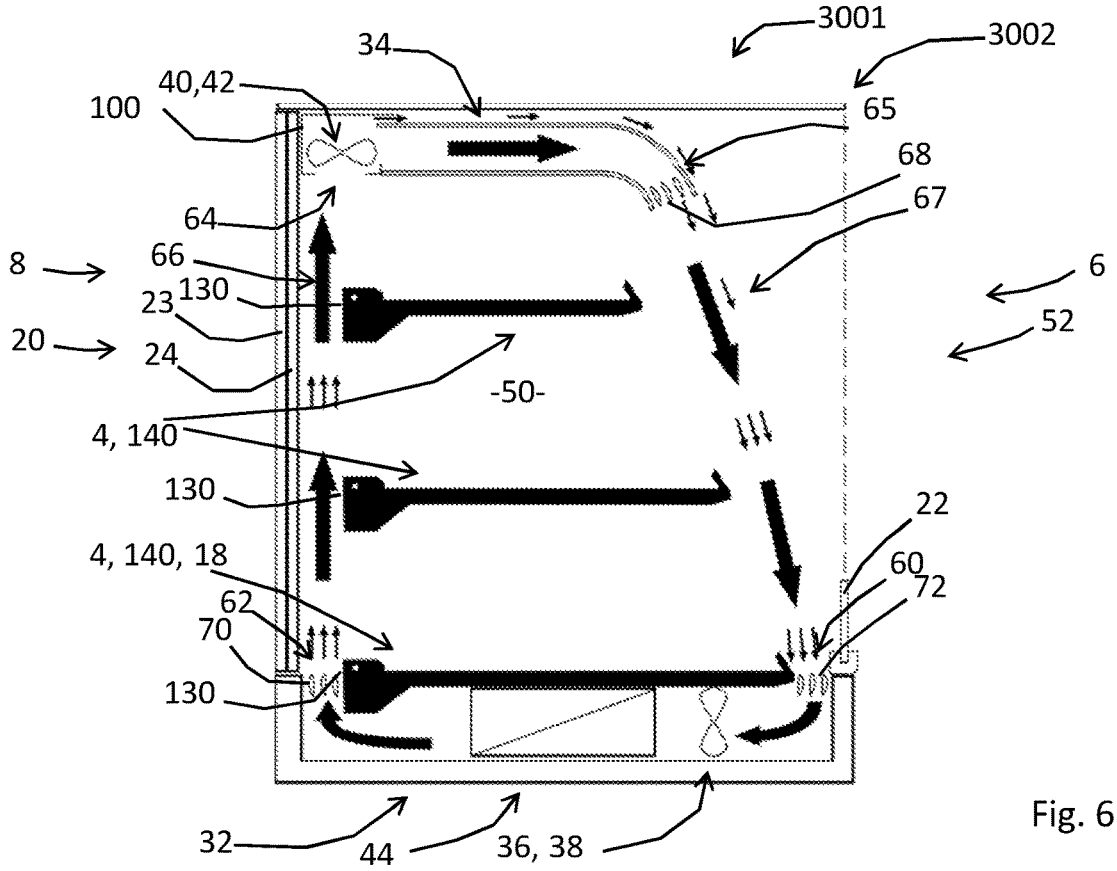
FIG. 6 shows the embodiment and configuration of FIG. 5, operating as refrigerated unit.

FIGS. 5-6 show a system 3001 with a display unit 3002 according to another embodiment of the invention. The display unit 3002 as shown is the same, or similar, to the ones shown in the previous embodiments, and may have some different elements as described in the final paragraphs of this specification. According to the inventive concept, the display unit 3002 itself is provided with an air refrigerator 44, while at least one of the multiple shelves 4 is a hollow shelf 140 with a shelf air outlet at the front side, a shelf air inlet at the back side, a shelf air forcing apparatus, and a shelf heater (details inside of the hollow shelf 140 not shown).

Figure 7:
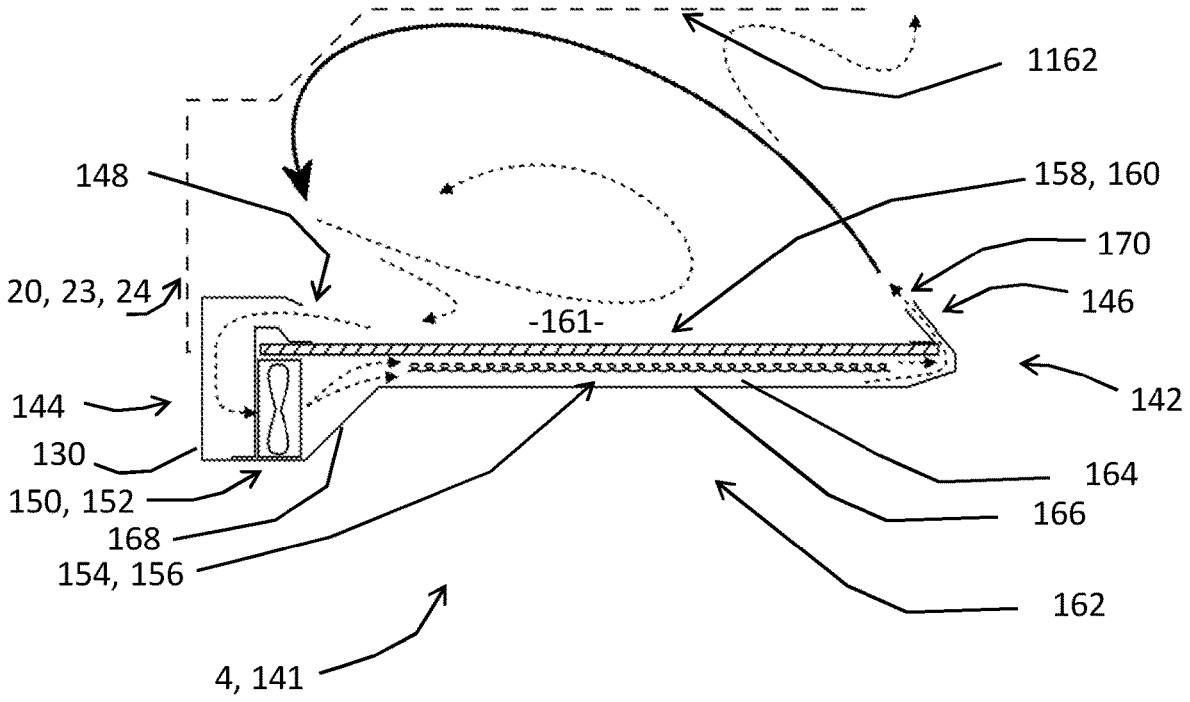
FIG. 7 shows in detail a cross-section view of a heated shelf.

FIG. 7 shows in detail a similar hollow shelf 141 which has a front side 142 and a back side 144, which in use correspond to the front side 6 and the back side 8 of the display unit 2. The hollow shelf 141 comprises at least at least one shelf air outlet 146 at the front side 142, one shelf air inlet 148 at the back side 144, a shelf air forcing apparatus 150, in this embodiment an axial-flow fan 152, and a shelf heater 154, in this case a flat electrical heating element 156.

The hollow shelf 141 comprises a substantially flat shelf top 158, which functions as placing side 160 on which food items can be positioned in a storage space 161 above the relevant shelf. The hollow shelf 141 further comprises shelf sides (not shown), and a shelf bottom 162. The shelf top 158, shelf sides and shelf bottom 162 define an inner space 164. The inner space 164 of the hollow shelf 141 fluidly connects the shelf air inlet 148 with the shelf air outlet 146.

The shelf bottom has a flat section 166, extending in parallel to the shelf top 158 over a forward and middle part of the shelf 141, and has a down bulking section 168 which extends downwards for defining an enlarged portion of the inner space 164 for housing the axial-flow fan 152. The axial-flow fan 152 is in fluid connection with the shelf air inlet 148 and the shelf air outlet 146 for moving air from the shelf air inlet 148 through the hollow shelf 141 to the shelf air outlet 146.

The flat shelf heater 154 extends inside the inner space 164 for heating the air in the inner space 164 of the hollow shelf 141, and for providing heat to the placing side 160. The shelf air outlet 146 defines a flow direction 170 for air flowing out of the outlet, and the flow direction 170 points away upwards from the placing side 160 and backwards towards the back side 144 of the hollow shelf 141. The air flow is deflected by a shelf bottom 162 of a shelf above the relevant shelf 141, or the top wall 12 of the display unit 2, as well as by the back wall 20 and/or the back doors 23, 24, as shown with dotted lines.

The hollow shelf 140 of FIGS. 5 and 6 differs from the hollow shelf 141 of FIG. 7, in that the back edge 130 of the hollow shelf 140 is spaced horizontally from the back wall 20 and/or back doors 23, 24, when positioned in the display unit 2, for providing sufficient space for a back air curtain 66 between the back edge 130 of the hollow shelf and the back wall 20 and/or back doors 23, 24, as shown in FIG. 6. The hollow shelf 140 of this embodiment comprises a replaceable back portion 172. When put into place at the back side 144 of the hollow shelf 140, the replaceable back portion 172 extends the hollow shelf 140 to the back wall 20 and/or back doors 23, 24 of the display unit 2, as shown in FIG. 5. The replaceable back portion 172 comprises a joint 174, in this embodiment a pivot 176, in order to move the replaceable back portion 172 from a retracted position, wherein the back edge 130 of the hollow shelf 140 is spaced horizontally from the back wall 20 and/or back doors 23, 24 of the display unit 2, to an extended position, wherein a back side 178 of the replaceable back portion 172 is positioned at the back wall 20 and/or back doors 23, 24 of the display unit 2. This position improves the air circulation above the hollow shelf 140 while the display unit 2 is in use as heated display unit, because it decreases the exchange of air between the space above and below the hollow shelf 140. By retracting the replaceable back portion 172, the shelf 140 can remain in the display unit 2 while it is being used as refrigerated display unit 2.

The hollow shelves 141 are suitable for a heated operation of the display unit 2, while they are further suitable for a refrigerated operation in a display unit with a back air duct instead of a back air curtain. In an embodiment of the system 3001 with a back air curtain, where these hollow shelves 141 are positioned, it is preferably possible to remove one or more of the hollow shelves 141 and replace them by a flat shelf without a shelf air forcing apparatus, e.g. a flat shelf 5 as shown and described in relation to the previous embodiments, by means of shelf support means and connection means, e.g. such as those as shown in, and described in relation to, FIG. 4.

In use, an inventive display unit as defined by the claims, such as one of the display units 2, 1002, 2002, 3003 as described above, is used for either storing refrigerated or heated food products. While in use for refrigerated goods, the slats at the outlets provide for a laminar air flow air curtain and direct the air curtain to the respective inlet. This reduces air movement around the refrigerated food products, which prolongs the time that the food products are consumable.

In use, the same, or similar, display unit is provided with back doors and a back air curtain. This enables the display unit to be used in a crowded and busy environment wherein it is important that the open front chamber is accessible from the back as well, for refilling the display unit without disturbing the customers.

The back and front air curtain, in particular as they have a directed laminar flow, keep the food products inside of the open front chamber in a refrigerated envelope, thus keeping the food products at a desired low temperature compared to the ambient temperature, without the need for directing refrigerated air onto the food products.

A display unit with back and front air curtains, in particular directed laminar air curtains, is also very suitable to be used with exchangeable, height adjustable shelves, as the circulation of refrigerated air is independent of the shelves as long as they do not extend into the air curtains.

In use, the same, or similar, display unit is provided with one or more transparent walls and a conduit wall, as described in relation to FIGS. 2 and 3, although these features are present in all the shown embodiments. The transparent walls improve the visibility of the food products inside the open front chamber. Ambient temperature conditions of the display unit may range from 12° C. to 25° C., while the air temperature of the air which is used to cool the content of the display unit and to create an air curtain may be in the range of −4° C. to +4° C. In prior art display units, this cold air would cause condensation on the outside of the transparent wall and diminish the visibility of the food products. This is solved according to the invention by admitting ambient air between the transparent wall and the conduit wall. This prevents cooling off of the transparent wall, so that the temperature of the transparent wall remains above the dew point of the ambient air. At the same time, refrigerated air is admitted between the transparent wall and the conduit wall to, in order to keep the temperature of the air flowing along the conduit wall at a low level, so that the temperature of the conduit wall itself remains above the dew point of this air, in order to prevent condensation on the conduit wall.

The prevention of condensation is improved by minimising the mixture of ambient air and refrigerated air in the air conduit. This is achieved by a combination of having a relative flat air conduit and by a suitable choice of the dimensions of both air inlets. The optimum flatness of the air conduit and the mutual ratios of the dimensions of the air conduit and the air inlets is different for different sized display units and for display units operating under different conditions, and is therefore to be determined by trial and error. It is noted that a complete separation of the ambient air and the refrigerated air in the air conduit is impossible, and also not necessary. In other words, the ambient air flowing along the inside of the transparent wall will be slightly colder than the ambient air outside of the display unit. Likewise, the refrigerated air in the air conduit will be slightly warmer than the refrigerated air at the other side of the conduit wall. This does not deter from preventing condensation, as long as the temperatures of the relevant walls are above the dew point of the surrounding air.

In use, the same, or similar, display unit is provided with hollow shelves, as described in relation to FIGS. 5-7. Such hollow shelves may be fixed in the display unit, or exchangeable for other shelves. The inventive hollow shelves direct heated air substantially entirely into the storage space above the relevant shelf. This enables the storage of heated products on a display unit which is otherwise designed for refrigerating food products.

Throughout this specification, the term air duct should be interpreted broadly, in that one air duct, e.g. the lower air duct or the upper air duct, may comprise different physical parts such as pipes, connectors, adapters. Moreover, a part of the air moving apparatus and/or the air refrigerator, or the inside of a double wall may be considered to be part of the air duct too. The air conduit does not comprise physical parts, such as a further wall, in the air conduit between the transparent wall and conduit wall to separate the ambient air and the cooled air in the air conduit, in particular no physical parts, such as a further wall, extend between the transparent wall and conduit wall along the length of the air conduit.

The material of transparent wall is preferably glass or plastic, such as polycarbonate (PC), polymethyl methacrylate (e.g. Perspex, registered trademark of the Lucite International UK Limited), polyethylene terephthalate (PET) or polyvinyl chloride (PVC). The material of non-transparent walls is preferably metal or plastic, such as an insulating type of plastic, e.g. a plastic foam. A wall is considered transparent in the context of this specification if a user can see through a substantial part of the relevant wall, and is able to see at least part of the food products in the open front chamber through the transparent wall.

Several variants are possible within the scope of the attached claims. The features of the above described preferred embodiment(s) may be replaced by any other feature within the scope of the attached claims, such as the features described in other embodiments, and in the following paragraphs.

The inventive slats do not need to be arranged as straight parallel slats. In an embodiment, the slats are short and define an open honeycomb structure. In an embodiment, the slats have a non-rectangular profile as seen in cross-section. In particular, the slats have a thickness in their middle part which is larger than at the edges. This reduces drag. In another embodiment, the slats have a rectangular cross-section. This provides a simple solution which reduces the cost.

In an embodiment, the display unit may be provided with fixed shelves instead of replaceable shelves. Both a fixed shelf which is placed permanently or semi-permanently in the display unit and a replaceable shelf are considered a shelf which is placeable in the display unit in the context of this description. In an embodiment, a lower shelf is integrated with the bottom wall of the open front chamber. In an embodiment, a plurality of shelves, in particular all the shelves, are hollow shelves with an inner space, a shelf air inlet at the back side, a shelf air outlet at the front side, a shelf air forcing apparatus, and a shelf heater. In an embodiment, the shelf air forcing apparatus is provided at the relevant hollow shelf in fluid communication with the shelf air inlet and the shelf air outlet, but not inside of the hollow shelf, or at least not completely inside of the hollow shelf. In an embodiment, the shelf heater is one, or a series of, heating wires, in particular spiral shaped wires.

In an embodiment, the inner space of the hollow shelf is provided with one or more air ducts for connecting the shelf air inlet with the shelf air outlet. In an embodiment, the at least one shelf air outlet is directed downwards for creating an air curtain in front of the storage space below the relevant shelf. In a variant, the at least one shelf air outlet is directed upwards, but substantially not backwards, for creating an air curtain in front of the storage space above the relevant shelf. In an embodiment, one hollow shelf is provided with a plurality of shelf air outlets. In particular, at least part, more in particular all, of the plurality of shelf air outlets are positioned at the front side of the relevant shelf and/or are directed upwards and/or backwards. In particular, at least one of the plurality of shelf air outlets is provided at the front side of the shelf, while a portion of the plurality of shelf air outlets is positioned between the front and the back side of the shelf at the placing side of the relevant hollow shelf and/or at an underside of the relevant hollow shelf.

In an embodiment, the replaceable back portion of the hollow shelf is not connected via a joint and is to be taken out of the display unit, when said unit is used as refrigerated display unit with a back air curtain. In an embodiment, the replaceable back portion is connected to the hollow shelf via a sliding joint. In an embodiment, the hollow shelf completely extends to the back wall without a back portion which is removable. In such an embodiment, the relevant hollow shelf is taken out of the display unit when said unit is used as refrigerated display unit with a back air curtain. In another embodiment, the back side of the hollow shelf is spaced from the back wall in order to provide space for the back air curtain.

In an embodiment, at least one of the walls is double walled for insulation, and in particular provided with insulation material. In an embodiment, the bottom wall is double walled, wherein the space between the bottom walls forms the lower air duct. In another embodiment, the bottom wall is double walled, wherein a pipe or other separate means is provided as lower air duct in the space between the bottom walls. In yet another embodiment, the bottom wall is a single wall and the lower air duct is provided as separate means either inside the display unit, e.g. on the bottom wall, or at the outside of the display unit.

In an embodiment, the top wall is double walled, wherein the space between the top walls forms the upper air duct. In another embodiment, the top wall is double walled, wherein a pipe or other separate means is provided as upper air duct in the space between the top walls. In yet another embodiment, the top wall is a single wall and the upper air duct is provided as separate means either inside the display unit, e.g. attached under the top wall, or at the outside of the display unit.

While the display unit has an open front chamber, in an embodiment there are one or more front walls at the lower, side, or upper edge of the open front. In an embodiment, the conduit wall is positioned parallel of a side wall, a back wall, or a front wall. In an embodiment, one wall is a transparent wall. In another embodiment, a plurality of walls are a transparent wall. In particular, one of the plurality of transparent walls is provided with a conduit wall. In a variant, two or more of the plurality of transparent walls are each provided with a conduit wall. In an embodiment, the conduit wall is not part of an air duct, but just a wall provided in parallel to another wall.

In an embodiment, more than two air forcing apparatus are provided. In particular, a plurality of air forcing apparatus is provided in parallel, i.e. next to each other. Such a row of a plurality of air forcing apparatus is provided in the lower air duct and/or in the upper air duct.

In an embodiment, the air forcing apparatus is a fan which is provided in the relevant duct. In an embodiment, a centrifugal fan is used as air forcing apparatus. In another embodiment, a cross-flow fan is used as air forcing apparatus. In yet another embodiment, a fan using the coanda effect is used as air forcing apparatus. In this embodiment, the blades of the actual fan are outside of the relevant air duct, sucking in a relative small amount of air, compressing this air and blowing a thin high-velocity laminar airflow from holes or a continuous slot across the inner surface of the relevant duct. This high-velocity air induces and/or entrains ambient air through viscous shearing, thus multiplying the amount of air which is drawn through the relevant duct. In yet another embodiment, a bellows is used as an air forcing apparatus.

In an embodiment, the air refrigerator surrounds the relevant air duct, e.g. by cooling the wall of the air duct from the outside. In another embodiment, the air refrigerator comprises a heat exchanger, wherein a first side of the heat exchanger is part of the air duct, while a second side of the heat exchanger is in contact with a cooling fluid.

In an embodiment, the back door is a pivotable door, a loose panel which is to be removed from the back of the display unit, or a curtain. In an embodiment, a slidable back door slides in a vertical direction. In an embodiment, the open front may be provided by a curtain or a front door for temporarily closing the front of the display unit.

In an embodiment, the air circulation system comprises a back air duct which fluidly connects the lower air duct with the upper air duct. The position and number of air refrigerators and air moving apparatus are less critical in such an embodiment, than in an embodiment with a back air curtain. The air refrigerator(s) and/or air moving apparatus are provided at the lower air duct, the back air duct, and/or the upper air duct.

In an embodiment, there is a plurality of lower air ducts extending in parallel from the front to the back side of the display unit. In an embodiment, there is a plurality of upper air ducts extending in parallel from the back to the front side of the display unit. In an embodiment, there is a plurality of back air ducts each extending from a lower air duct to an upper air duct.

In an embodiment, there is a plurality of lower front inlets. In particular, the plurality of lower front inlets communicates with one and the same lower air duct. In a variant, each of the plurality of front inlets communicates with an individual lower air duct. In an embodiment, there is a plurality of upper front outlets. In particular, the plurality of front outlets communicates with one and the same upper air duct. In a variant, each of the plurality of front outlets communicates with an individual upper air duct. The same or similar embodiments are possible for the back inlets and back outlets.

In an embodiment, the upper air treatment system comprises only the air refrigerator. By cooling the air in the upper air duct, it becomes heavier than the ambient air and as a result flows downwards from the upper front outlet without the need for an upper air moving apparatus. In an embodiment, the upper air treatment system comprises the first air refrigerator, and there is no second air refrigerator. This means that the air in the upper air duct is cooled sufficiently for cooling the whole display unit. In an embodiment, the first air refrigerator is provided in the lower air duct, and the second air refrigerator is provided in the upper air duct. In an embodiment, the second air forcing apparatus is provided in the upper air duct.

The invention claimed is:

1. A system for storing and displaying food products, comprising:

a display unit for storing and displaying food products, and multiple shelves, wherein the display unit has a front side and a back side, and comprises multiple walls, including a top wall, a left side wall, a right side wall, a bottom wall, and a back wall, and the display unit further comprises an air circulation system, and a first air refrigerator, in which the top, left side, right side, bottom, and back walls delimit an open front chamber for the food products, such that the open front chamber is accessible from the open front, the multiple shelves each comprise a placing side, the multiple shelves are placeable in the display unit to each extend in the open front chamber in a vertical spaced relationship and to define an individual corresponding storage space above the respective placing side, the air circulation system comprises a lower air duct with a lower front inlet, an upper air duct with an upper front outlet, and a first air forcing apparatus, the first air forcing apparatus is provided for moving air through the lower and upper air ducts, from the lower front inlet towards the upper front outlet, the first air refrigerator is provided for cooling the air which is moved from the lower front inlet towards the upper front outlet, the upper front outlet is directed at the lower front inlet for creating a front air curtain in front of the open front, wherein at least one of the multiple shelves is a hollow shelf with an inner space, a front side and a back side, which front side and back side in use correspond to the front side and the back side of the display unit, wherein the hollow shelf comprises at least one shelf air outlet at the front side of the hollow shelf, at least one shelf air inlet at the back side of the hollow shelf, a shelf air forcing apparatus, and a shelf heater, and wherein the shelf air forcing apparatus is in fluid connection with the shelf air inlet and the shelf air outlet for moving air from the shelf air inlet through the hollow shelf to the shelf air outlet.

2. The system according to claim 1, wherein the shelf heater is provided in the inner space for heating the air in the inner space of the hollow shelf.

3. The system according to claim 1, wherein the shelf heater is positioned so as to provide heat to the placing side.

4. The system according to claim 1, wherein the shelf heater is a flat heating element extending in the inner space of the hollow shelf.

5. The system according to claim 1, wherein the inner space of the hollow shelf fluidly connects the at least one shelf air inlet with the at least one shelf air outlet.

6. The system according to claim 1, wherein the at least one shelf air outlet defines a flow direction for air flowing out of the outlet, and the flow direction points away upwards from the placing side and backwards towards the back side of the hollow shelf, such that in use the air flowing out of the outlet is directed substantially entirely into the corresponding storage space.

7. The system according to claim 1, wherein the shelf air forcing apparatus is provided inside the inner space.

8. The system according to claim 1, wherein the display unit comprises multiple shelf support means at different heights for supporting the at least one of the shelves at different vertical positions in the display unit.

9. The system according to claim 1, wherein the air circulation system further comprises a lower back outlet at the lower air duct, and an upper back inlet at the upper air duct, and the lower back outlet is directed at the upper back inlet for creating a back air curtain in front of the back wall.

10. The system according to claim 9, wherein a back edge of the hollow shelf is spaced horizontally from the back wall, when positioned in the display unit, for providing sufficient space for the back air curtain between the back edge of the hollow shelf and the back wall.

11. The system according to claim 10, wherein the hollow shelf comprises a replaceable back portion for extending the hollow shelf to the back wall of the display unit.

12. The system according to claim 10, wherein the hollow shelf comprises a replaceable back portion comprising a joint configured to move the replaceable back portion from a retracted position, wherein the back edge of the hollow shelf is spaced horizontally from the back wall, to an extended position, wherein a back side of the replaceable back portion is positioned at the back wall.

13. The system according to claim 12, wherein the joint is a pivot.

14. The system according to claim 1, wherein the back wall comprises a back door, so that the open front chamber is accessible by opening the back door.

15. The system according to claim 1, wherein at least one further one of the multiple shelves is a flat shelf without a shelf air forcing apparatus.

16. The system according to claim 1, wherein at least one of the upper front outlet and the lower back outlet is provided with slats for guiding the air curtain.

17. The system according to claim 1, wherein at least one of the multiple walls is a transparent wall, wherein the display unit further comprises a conduit wall, which is positioned substantially in parallel to, and at the chamber side of, the transparent wall for creating an air conduit between the conduit wall and the transparent wall, and wherein the air conduit comprises a first conduit inlet, a second conduit inlet, and a conduit outlet, the first conduit inlet fluidly connects the at least one air duct with the air conduit for diverting a portion of refrigerated air moving through the at least one air duct into the air conduit, the second conduit inlet fluidly connects ambient air outside of the display unit with the air conduit for letting in ambient air via the second conduit inlet into the air conduit, and wherein the air conduit is configured to jointly guide the portion of refrigerated air and the ambient air from the respective first conduit inlet and second conduit inlet towards the conduit outlet for jointly exiting the air conduit from the conduit outlet.

18. A method for storing and displaying food products in a display unit, the method comprising:

providing the display unit, wherein the display unit comprises an air refrigerator, providing at least one hollow shelf with a shelf heater, a shelf air inlet at a back side of the hollow shelf, and a shelf air outlet at a front side of the hollow shelf, providing food products on the hollow shelf, drawing in air through the shelf air inlet by applied suction with a shelf air forcing apparatus, moving the sucked in air from the shelf air inlet through the hollow shelf to the shelf air outlet, heating the moving air with the shelf heater in the hollow shelf, and blowing the heated air out of the shelf air outlet.

19. The method according to claim 18, wherein the heated air which is blown out of the shelf air outlet is blown upwards and backward, substantially entirely into a storage space above the hollow shelf.

* * * * *